US007746301B2

(12) United States Patent
Wu

(10) Patent No.: US 7,746,301 B2
(45) Date of Patent: Jun. 29, 2010

(54) DRIVING CIRCUIT HAVING VOLTAGE DETECTING CIRCUIT AND LIQUID CRYSTAL DISPLAY USING SAME

(75) Inventor: Hsi-Yao Wu, Miao-Li (TW)

(73) Assignee: Innolux Display Corp., Miao-Li County (TW)

( * ) Notice: Subject to any disclaimer, the term of this patent is extended or adjusted under 35 U.S.C. 154(b) by 874 days.

(21) Appl. No.: 11/584,694

(22) Filed: Oct. 20, 2006

(65) Prior Publication Data

US 2007/0091040 A1 Apr. 26, 2007

(30) Foreign Application Priority Data

Oct. 20, 2005 (CN) ..... 2005 1 0100562

(51) Int. Cl.
*G09G 3/36* (2006.01)

(52) U.S. Cl. ..... 345/87; 345/212

(58) Field of Classification Search ..... 345/87, 345/89, 98, 100, 211–212
See application file for complete search history.

(56) References Cited

U.S. PATENT DOCUMENTS 6,476,590 B2 11/2002 Chou
7,359,290 B2 * 4/2008 Chen et al. ..... 368/242
2002/0003964 A1 * 1/2002 Kanbara et al. ..... 396/661
2004/0160408 A1 * 8/2004 Hwang ..... 345/102
2004/0174330 A1 * 9/2004 Huang et al. ..... 345/100
2005/0264513 A1 * 12/2005 Lim ..... 345/100

FOREIGN PATENT DOCUMENTS

CN 1601599 A 3/2005
TW 594647 B 6/2004
TW 237229 B 8/2005

* cited by examiner

*Primary Examiner*—Chanh Nguyen
*Assistant Examiner*—Tsegaye Seyoum
(74) *Attorney, Agent, or Firm*—Wei Te Chung

(57) ABSTRACT

An exemplary liquid crystal display (LCD) (20) includes: a gate driving integrated circuit (IC) (22) for scanning an LCD panel (24) of the LCD; a data driving IC (23) for providing a plurality of gradation voltages to the LCD panel; a primary control circuit board (21) configured for providing the operation voltage to the data driving IC; and a flexible printed circuit board (25) connected between the LCD panel and the primary control circuit board. The data driving IC includes a voltage detecting circuit (230), which detects an operation voltage applied to the gate driving IC and is configured to provide an all-scanning signal to the gate driving IC.

18 Claims, 3 Drawing Sheets

DRIVING CIRCUIT HAVING VOLTAGE DETECTING CIRCUIT AND LIQUID CRYSTAL DISPLAY USING SAME

FIELD OF THE INVENTION

The present invention relates a driving circuit having a voltage detecting circuit for eliminating residual image and a liquid crystal display (LCD) using the same.

GENERAL BACKGROUND

An LCD has the advantages of portability, low power consumption, and low radiation, and has been widely used in various portable information products such as notebooks, personal digital assistants (PDAs), video cameras and the like. Furthermore, the LCD is considered by many to have the potential to completely replace CRT (cathode ray tube) monitors and televisions.

Usually, an LCD needs an external power supply for providing operating power. When the LCD operates, much electric charge is stored therein. When the LCD is powered off, electric charge stored therein is not discharged quickly. This makes the voltage at the external power supply connection drop slowly. As a result, a gate driving circuit and a data driving circuit that drive the LCD operate incorrectly, thereby producing a residual image on the LCD.

FIG. 4 is a schematic circuit diagram of a typical LCD. The LCD 10 includes an LCD panel 14 and a driving circuit (not labeled). The driving circuit includes a gate driving integrated circuit (IC) 12, a data driving IC 13, a primary control circuit board 11, and a flexible printed circuit board (FPCB) 15. The gate driving IC 12 and the data driving IC 13 are respectively formed on two adjacent sides of the LCD panel 14 by chip on glass (COG) technology. The FPCB 15 is connected between the LCD panel 14 and the primary control circuit board 11. The gate driving IC 12 scans the LCD panel 14. The data driving IC 13 provides a plurality of gradation voltages to the LCD panel 14 when the LCD panel 14 is scanned.

The primary control circuit board 11 includes a driving control circuit 111, a power supply circuit 112 and a voltage detecting circuit 113. The power supply circuit 112 directly provides an operation voltage (not labeled) to the driving control circuit 111, and respectively provides two operation voltages V2, V1 to the gate driving IC 12 and the data driving IC 13 via the FPCB 15.

The voltage detecting circuit 113 generates an all-scanning signal "Xon" when the operation voltage V2 falls below a predetermined threshold voltage. Then, the voltage detecting circuit 113 transmits the all-scanning signal "Xon" to the gate driving IC 12 through a conducting lead (not labelled) configured on the FPCB 15. As the gate driving IC 12 receives the all-scanning signal "Xon", the gate driving IC turns on all of TFTs (thin film transistors) of the LCD panel 14. Thus the electric charge stored in the TFTs can be discharged quickly. As a result, the residual image on the LCD 10 does not appear when the LCD 10 is power off.

However, because the primary control circuit board 11 includes the voltage detecting circuit 113, the volume occupied by the primary control circuit board 11 is large. Furthermore, because the voltage detecting circuit 113 is configured on the primary control circuit board 11, the FPCB 15 needs a special conducting lead formed thereon for transmitting the all-scanning signal "Xon" from the voltage detecting circuit 113 to the gate driving IC 12.

What is needed, therefore, is a driving circuit of an LCD that can overcome the above-described deficiencies.

SUMMARY

An exemplary driving circuit of an LCD includes a gate driving IC for scanning an LCD panel of the LCD; a data driving IC for providing a plurality of gradation voltages to the LCD panel; a primary control circuit board configured for providing the operation voltage to the data driving IC; and a flexible printed circuit board connected between the LCD panel and the primary control circuit board. The data driving IC includes a voltage detecting circuit. The voltage detecting circuit is configured for detecting an operation voltage applied to the gate driving IC and providing an all-scanning signal to the gate driving IC.

Other advantages and novel features will become more apparent from the following detailed description when taken in conjunction with the accompanying drawings.

DETAILED DESCRIPTION OF PREFERRED EMBODIMENTS

Figure 1:
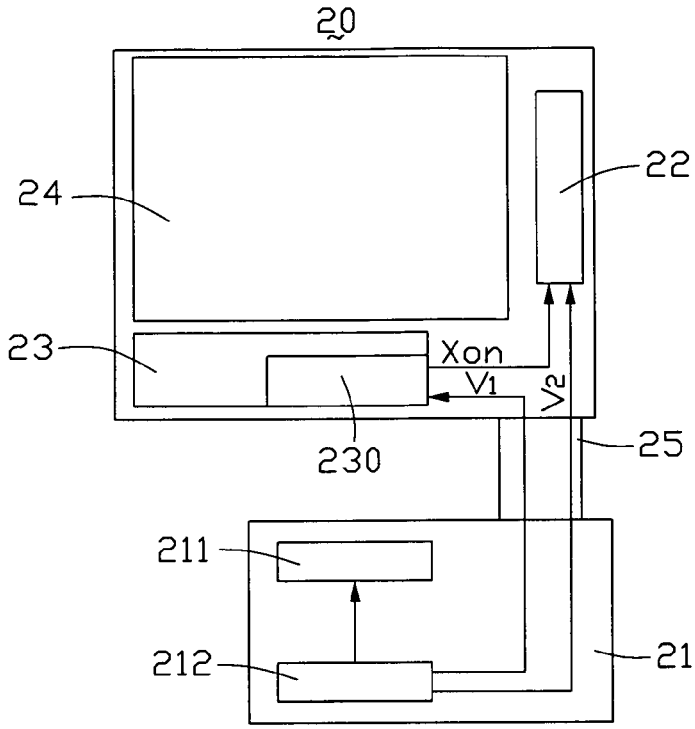
FIG. 1 is a schematic circuit diagram of an LCD according to a preferred embodiment of the present invention.

FIG. 1 is a schematic circuit diagram of an LCD according to a preferred embodiment of the present invention. The LCD 20 includes an LCD panel 24 and a driving circuit (not labeled). The driving circuit includes a gate driving IC 22, a data driving IC 23, a primary control circuit board 21, and an FPCB 25. The gate driving IC 22 and the data driving IC 23 are respectively formed on two adjacent sides of the LCD panel 24 by chip on glass (COG) technology. The FPCB 25 is connected between the LCD panel 24 and the primary control circuit board 21. The gate driving IC 22 scans the LCD panel 24. The data driving IC 23 provides a plurality of gradation voltages to the LCD panel 24 when the LCD panel 24 is scanned.

The primary control circuit board 21 includes a driving control circuit 211 and a power supply circuit 212. The power supply circuit 212 directly provides an operation voltage to the driving control circuit 211, and respectively provides operation voltages V2, V1 to the gate driving IC 22 and the data driving IC 23 via the FPCB 25.

The LCD panel 24 includes a conducting lead (not labeled) thereon formed by semiconductor technology. The conducting lead is configured between the gate driving circuit 22 and the data driving circuit 23 for electrically connecting the gate driving circuit 22 and the data driving circuit 23.

The data driving circuit 23 includes a voltage detecting circuit 230 integrated therein. The voltage detecting circuit 230 generates an all-scanning signal "Xon" when the operation voltage V1 falls below a predetermined threshold voltage. Then, the voltage detecting circuit 230 transmits the all-scanning signal "Xon" to the gate driving IC 22 through the conducting lead. The gate driving IC 22 turns on all of TFTs of the LCD panel 24 when the gate driving IC 22 receives the all-scanning signal from the voltage detecting circuit 230. Thus the electric charge stored in the TFTs can be discharged quickly. As a result, a residual image on the LCD 20 does not appear when the LCD 20 is power off.

Figure 2:
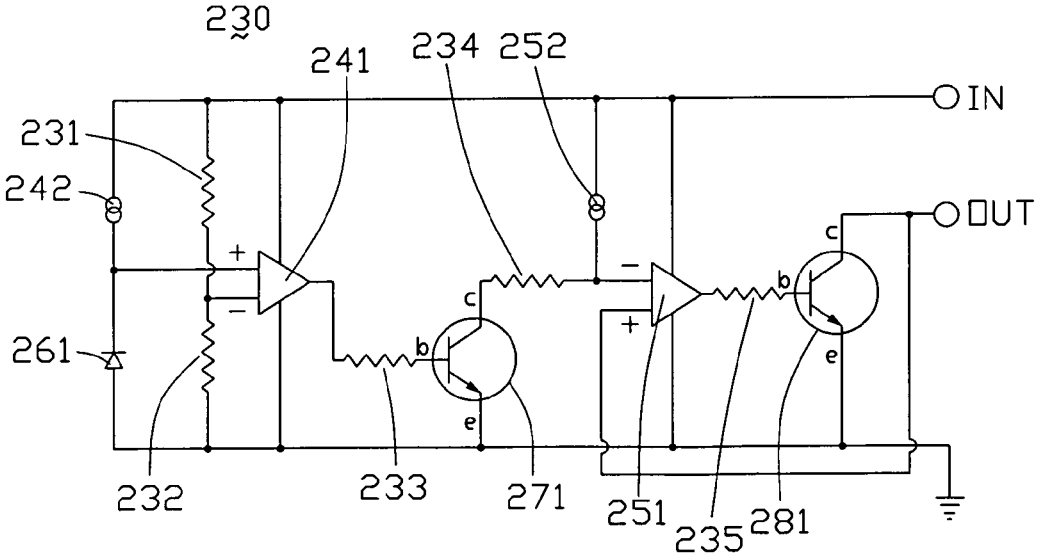
FIG. 2 is a schematic circuit diagram of a voltage detecting circuit of the circuit of FIG. 1.

Referring to the FIG. 2, the voltage detecting circuit 230 includes an input terminal "IN" for receiving the operation voltage V1, an output terminal "OUT" connected to the conducting lead for providing the all-scanning signal "Xon" to the gate driving IC 22, a first comparator 241, a second comparator 251, a first negative-positive-negative (NPN) bipolar transistor 271, a second NPN bipolar transistor 281, a first constant current power circuit 242, a second constant current power circuit 252, a constant voltage diode 261, and a plurality of resistors 231, 232, 233, 234, 235.

The resistors 231, 232 are connected in series between the input terminal "IN" and ground. The first constant current circuit 242 and the constant voltage diode 261 are also connected in series between the input terminal "IN" and ground. A joint node between the resistors 231, 232 is connected to an inverting input of the first comparator 241. A joint node between the first constant current circuit 242 and the constant voltage diode 261 provides a constant reference voltage to a noninverting input of the first comparator 241. An output of the first comparator 241 is connected to a base electrode "b" of the first NPN bipolar transistor 271 via the resistor 233. An emitter electrode "e" of the first NPN bipolar transistor 271 is connected to ground. A collector electrode "c" of the first NPN bipolar transistor 271 is connected to the input terminal "IN" via the resistor 234 and the second constant current power circuit 252 in series. The collector electrode "c" of the first NPN bipolar transistor 271 is connected to an inverting input of the second comparator 251 via the resistor 234. A noninverting input of the second comparator 251 is connected to the output terminal "OUT". An output of the second comparator 251 is connected to a base electrode "b" of the second NPN bipolar transistor 281 via the resistor 235. An emitter electrode "e" of the second NPN bipolar transistor 281 is connected to ground. A collector electrode "c" of the second NPN bipolar transistor 281 is connected to the output terminal "OUT".

Figure 3:
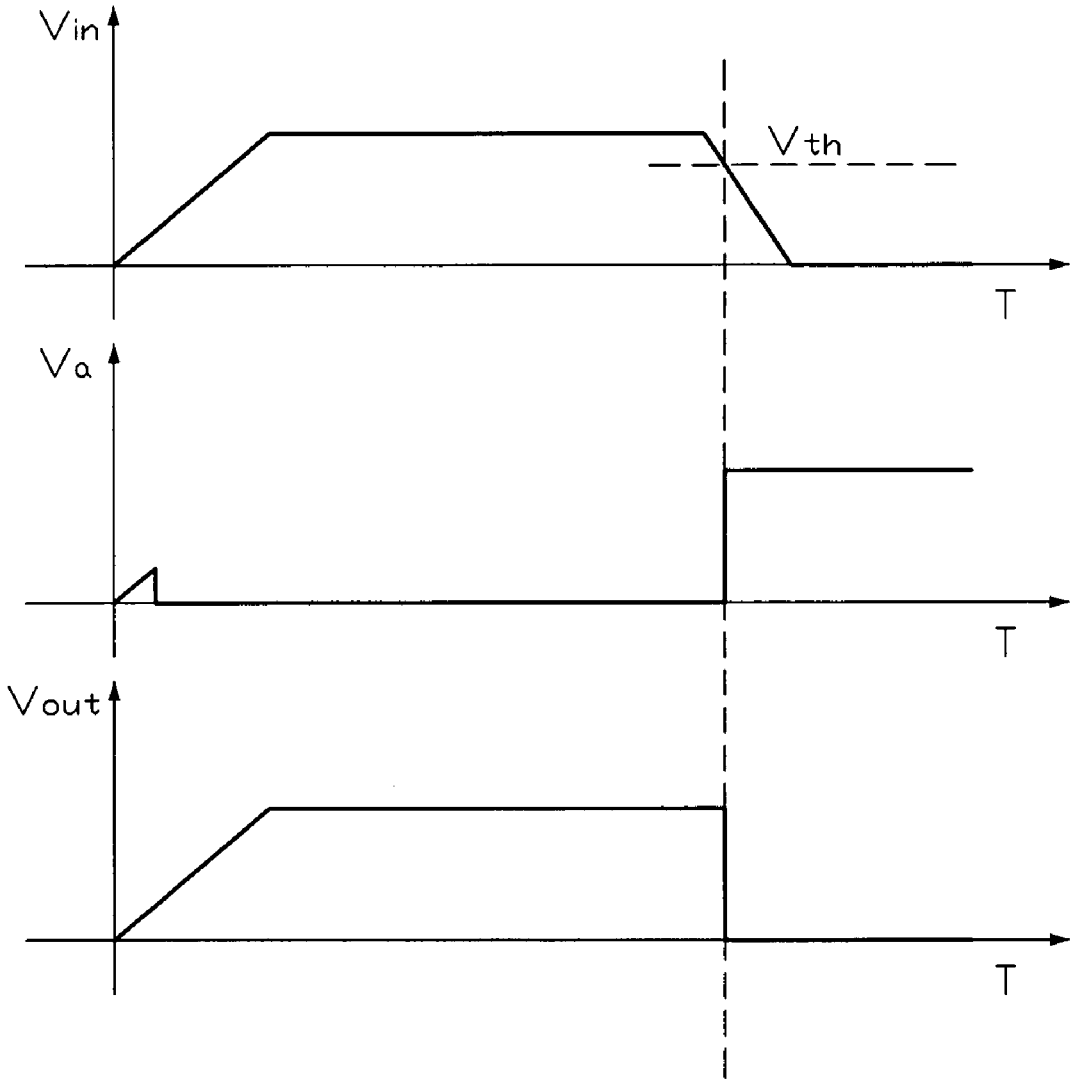
FIG. 3 is an abbreviated timing chart illustrating operation of the voltage detecting circuit of FIG. 2
Figure 4:
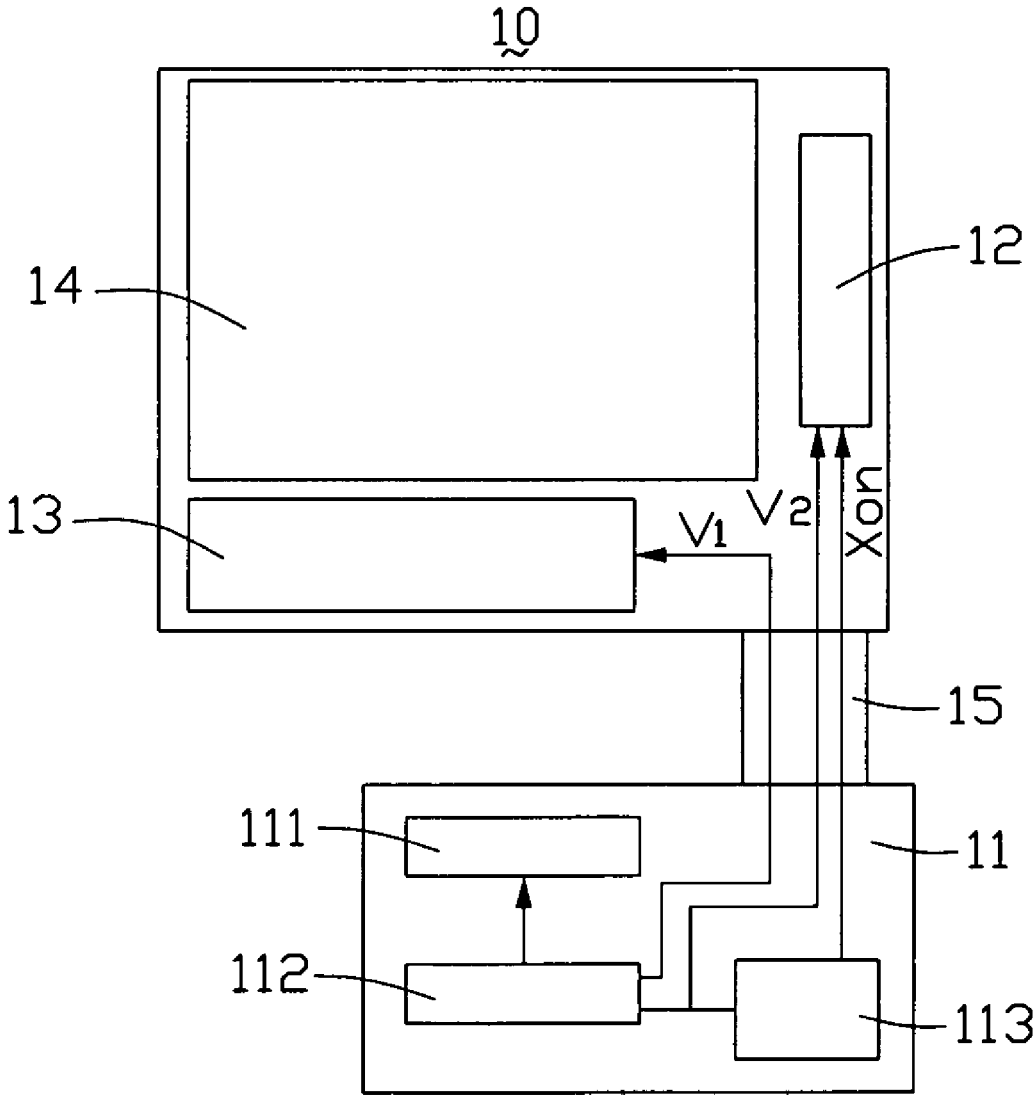
FIG. 4 (RELATED ART)
FIG. 4 is a schematic circuit diagram of a conventional LCD.

FIG. 3 is an abbreviated timing chart illustrating operation of the voltage detecting circuit 230. Vin represents the voltage wave provided to the input terminal "IN". Vth represents a predetermined threshold voltage lower than a maximum voltage provided to the input terminal "IN". Vout represents an output voltage wave of the output terminal "OUT". Va represents a voltage wave output from the output of the first comparator 241.

The operation of the voltage detecting circuit 230 is as follows. Normally, a constant operation voltage, such as the voltage V1, is applied to the input terminal "IN" from the power supply circuit 212. Because the constant reference voltage is set to be lower than a division voltage provided from the joint node between the resistors 231, 232, a voltage of the noninverting input of the first comparator 241 is lower than that of the inverting input of the first comparator 241. The first comparator 241 outputs a lower voltage to the base electrode "b" of the first NPN bipolar transistor 271 via the resistor 233. Thus, the first NPN bipolar transistor 271 turns off. The constant operation voltage, such as the voltage V1, is provided to the inverting input of the second comparator 251 via the second constant current circuit 252. Then the second comparator 251 outputs a low voltage to the base electrode "b" of the second NPN bipolar transistor 281 via the resistor 235. The second bipolar transistor 281 turns off. Thus the output terminal "OUT" of the voltage detecting circuit 230 outputs a high voltage to the gate driving IC 22 through the conducting lead.

When the LCD is turned off, the voltage V1 falls below a threshold voltage Vth. Thus the voltage of the noninverting input of the first comparator 241 is higher than that of the inverting input of the first comparator 241. Then, the first comparator 241 outputs a high voltage to the base electrode "b" of the first NPN bipolar transistor 271. The first NPN bipolar transistor 271 turns on. The inverting input of the second comparator 251 is connected to ground via the activated first NPN bipolar transistor 271. Then, the second comparator 251 outputs a high voltage to the base electrode "b" of the second NPN bipolar transistor 281. The second NPN bipolar transistor 281 turns on. Thus the output terminal "OUT" is connected to ground via the activated second NPN bipolar transistor 281. Therefore, the output terminal "OUT" outputs a zero volt voltage as an all-scanning signal "Xon" to the gate driving circuit 22 through the conducting lead.

In summary, because the voltage detecting circuit 230 is integrated in the data driving IC 23, the primary control circuit board 21 need not generate an all-scanning signal "Xon" and provide the all-scanning signal "Xon" to the gate driving IC 22 through the FPCB 25. Thus the configuration of the FPCB 25 and the primary control circuit board 21 is simple.

In an alternative embodiment of the present invention, the voltage detecting circuit 230 can be integrated in the gate driving IC 22 for detecting an operation voltage applied thereon. When the operation voltage applied to the gate driving IC 22 falls below a predetermined threshold voltage, the gate driving IC 22 performs a function of turning on all the TFTs of the LCD.

It is to be understood, however, that even though numerous characteristics and advantages of the present embodiments have been set out in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A driving circuit for a liquid crystal display (LCD), comprising:

a gate driving integrated circuit (IC) for scanning an LCD panel of the LCD;

a data driving IC for providing a plurality of gradation voltages to the LCD panel, the data driving IC comprising a voltage detecting circuit, which detects an operation voltage applied to the gate driving IC and is configured to provide an all-scanning signal to the gate driving IC;

a primary control circuit board configured for providing the operation voltage to the data driving IC; and a flexible printed circuit board connected between the LCD panel and the primary control circuit board;

wherein the voltage detecting circuit comprises an input terminal configured to receive the operation voltage, an output terminal configured to output the all-scanning signal, a first comparator, a second comparator, a first transistor, a second transistor, a first constant current power circuit, a second constant current power circuit, a constant voltage diode, a first resistor, and a second resistor, the first and second resistors are connected in series between the input terminal and ground, the first constant current circuit and the constant voltage diode are connected in series between the input terminal and ground, a joint node between the first and second resistors is connected to an inverting input of the first comparator, a joint node between the first constant current circuit and the constant voltage diode provides a constant reference voltage to a noninverting input of the first comparator, an output of the first comparator is connected to a base electrode of the first transistor, an emitter electrode of the first transistor is connected to ground, a collector electrode of the first transistor is connected to the input terminal via the second constant current power circuit, the collector electrode of the first transistor is connected to an inverting input of the second comparator, a noninverting input of the second comparator is connected to the output terminal, an output of the second comparator is connected to a base electrode of the second transistor, an emitter electrode of the second transistor is connected to ground, and a collector electrode of the second transistor is connected to the output terminal.

2. The driving circuit as claimed in claim 1, wherein the gate driving IC is configured to turn on all of thin film transistors (TFTs) of the LCD panel when the gate driving IC receives the all-scanning signal from the voltage detecting circuit.

3. The driving circuit as claimed in claim 1, further comprising a conducting lead connected between the gate driving IC and the data driving IC, the conducting lead configured for transmitting the all-scanning signal.

4. The driving circuit as claimed in claim 1, further comprising a third resistor connected between the output of the first comparator and the base electrode of the first transistor.

5. The driving circuit as claimed in claim 1, further comprising a fourth resistor connected between the collector electrode of the first transistor and the inverting input of the second comparator.

6. The driving circuit as claimed in claim 1, further comprising a fifth resistor connected between the output of the second comparator and the base electrode of the second transistor.

7. A driving circuit for a liquid crystal display (LCD), comprising:

a data driving integrated circuit (IC) for providing a plurality of gradation voltages to an LCD panel of the LCD; and a gate driving IC for scanning the LCD panel, the gate driving IC comprising a voltage detecting circuit for detecting an operation voltage applied thereon;

wherein the voltage detecting circuit comprises an input terminal for receiving the operation voltage, an output terminal for providing an all-scanning signal, a first comparator, a second comparator, a first transistor, a second transistor, a first constant current power circuit, a second constant current power circuit, a constant voltage diode, a first resistor, and a second resistor, the first and second resistors are connected in series between the input terminal and ground, the first constant current circuit and the constant voltage diode are connected in series between the input terminal and ground, a joint node between the first and second resistors is connected to an inverting input of the first comparator, a joint node between the first constant current circuit and the constant voltage diode provides a constant reference voltage to a noninverting input of the first comparator, an output of the first comparator is connected to a base electrode of the first transistor, an emitter electrode of the first transistor is connected to ground, a collector electrode of the first transistor is connected to the input terminal via the second constant current power circuit, the collector electrode of the first transistor is connected to an inverting input of the second comparator, a noninverting input of the second comparator is connected to the output terminal, an output of the second comparator is connected to a base electrode of the second transistor, an emitter electrode of the second transistor is connected to ground, a collector electrode of the second transistor is connected to the output terminal, and the gate driving IC performs a function of turning on all of thin film transistors (TFTs) of the LCD panel when the operation voltage is lower than a predetermined threshold voltage.

8. The driving circuit as claimed in claim 7, further comprising a primary control circuit board configured for providing the operation voltage provided to the gate driving IC.

9. The driving circuit as claimed in claim 7, further comprising a flexible printed circuit board connected between the LCD panel and the primary control circuit board.

10. The driving circuit as claimed in claim 7, further comprising a third resistor connected between the output of the first comparator and the base electrode of the first transistor.

11. The driving circuit as claimed in claim 7, further comprising a fourth resistor connected between the collector electrode of the first transistor and the inverting input of the second comparator.

12. The driving circuit as claimed in claim 7, further comprising a fifth resistor connected between the output of the second comparator and the base electrode of the second transistor.

13. A liquid crystal display (LCD) device, comprising:

an LCD panel;

a gate driving integrated circuit (IC) configured for scanning the LCD panel;

a data driving IC configured for providing a plurality of gradation voltages to the LCD panel, the data driving IC comprising a voltage detecting circuit which detects an operation voltage applied thereon and is configured to provide an all-scanning signal to the gate driving IC;

a primary control circuit board for providing the operation voltage to the data driving IC; and a flexible printed circuit board connected between the LCD panel and the primary control circuit board;

wherein the voltage detecting circuit comprises an input terminal for receiving the operation voltage, an output terminal for providing the all-scanning signal, a first comparator, a second comparator, a first transistor, a second transistor, a first constant current power circuit, a second constant current power circuit, a constant voltage diode, a first resistor, and a second resistor, the first and second resistors are connected in series between the input terminal and ground, the first constant current circuit and the constant voltage diode are connected in series between the input terminal and ground, a joint node between the first and second resistors is connected to an inverting input of the first comparator, a joint node between the first constant current circuit and the constant voltage diode provides a constant reference voltage to a noninverting input of the first comparator, an output of the first comparator is connected to a base electrode of the first transistor, an emitter electrode of the first transistor is connected to ground, a collector electrode of the first transistor is connected to the input terminal via the second constant current power circuit, the collector electrode of the first transistor is connected to an inverting input of the second comparator, a noninverting input of the second comparator is connected to the output terminal, an output of the second comparator is connected to a base electrode of the second transistor, an emitter electrode of the second transistor is connected to ground, and a collector electrode of the second transistor is connected to the output terminal.

14. The LCD device as claimed in claim 13, wherein the LCD panel comprises a conducting lead connected between the gate driving IC and the data driving IC, the conducting lead configured for transmitting the all-scanning signal.

15. The LCD device as claimed in claim 14, wherein the conducting lead is formed on the LCD panel by semiconductor means.

16. The LCD device as claimed in claim 13, wherein the gate driving IC is configured to turn on all of thin film transistors (TFTs) of the LCD panel when the gate driving IC receives the all-scanning signal from the voltage detecting circuit.

17. The LCD device as claimed in claim 13, wherein further comprising a third resistor connected between the output of the first comparator and the base electrode of the first transistor.

18. The LCD device as claimed in claim 17, wherein further comprising a fourth resistor connected between the collector electrode of the first transistor and the inverting input of the second comparator.

* * * * *